US006653773B1

(12) United States Patent
Lee

(10) Patent No.: US 6,653,773 B1
(45) Date of Patent: Nov. 25, 2003

(54) CATHODE RAY TUBE HAVING ENHANCED ELECTRON BEAM DEFLECTION EFFICIENCY

(75) Inventor: Bong-Woo Lee, Suwon-si (KR)

(73) Assignee: Samsung Display Devices Co., Ltd., Suwon-si (KR)

( * ) Notice: Subject to any disclaimer, the term of this patent is extended or adjusted under 35 U.S.C. 154(b) by 0 days.

(21) Appl. No.: 09/442,063

(22) Filed: Nov. 16, 1999

(30) Foreign Application Priority Data

Nov. 16, 1998 (KR) ..... 98-49096

(51) Int. Cl.[7] ..... H01J 31/00

(52) U.S. Cl. ..... 313/477 R; 313/440; 220/2.1 A; 220/2.2; 220/2.3 A

(58) Field of Search ..... 313/477 R, 440; 220/2.1 A, 2.2, 2.3 A

(56) References Cited

U.S. PATENT DOCUMENTS 5,763,995 A * 6/1998 Sano et al. ..... 313/477 R
5,929,559 A * 7/1999 Sano et al. ..... 313/477 R
5,962,964 A * 10/1999 Sano et al. ..... 313/440
6,002,203 A * 12/1999 Yolota et al. ..... 313/477
6,087,767 A * 7/2000 Sano et al. ..... 313/440
6,188,173 B1 * 2/2001 Kang et al. ..... 313/477 R
6,208,068 B1 * 3/2001 Lee et al. ..... 313/477 R

FOREIGN PATENT DOCUMENTS

CN 1168002 A 12/1997
JP 09-320492 12/1997

* cited by examiner

*Primary Examiner*—Vip Patel
*Assistant Examiner*—Mariceli Santiago
(74) *Attorney, Agent, or Firm*—Christie, Parker & Hale, LLP

(57) ABSTRACT

A cathode ray tube with a central axis includes a panel with an inner phosphor screen and a rear portion. A funnel is connected to the rear portion of the panel. The funnel sequentially has a body with a large-sized end and a small-sized end, and a cone portion with a large-sized end and a small-sized end. The large-sized end of the body is sealed to the rear portion of the panel. The small-sized end of the body meets the large-sized end of the cone portion at a point. The meeting point of the body and the cone portion becomes an inflection point of the funnel. The cone portion has a sectional shape varying from a circle to a non-circle like a rectangle while proceeding from the small sized end to the large sized end such that the cone portion is provided with a curvature radius Rh in the horizontal axis direction, a curvature radius Rv in the vertical axis direction, and a curvature radius Rd in the diagonal axis direction. The horizontal, vertical and diagonal curvature radii Rh, Rv and Rd of the cone portion of the funnel satisfy the following condition: Rh<Rv<Rd.

6 Claims, 4 Drawing Sheets

Rh<Rv<Rd

Rh<Rv<Rd

CATHODE RAY TUBE HAVING ENHANCED ELECTRON BEAM DEFLECTION EFFICIENCY

BACKGROUND OF THE INVENTION (a) Field of the Invention

The present invention relates to a cathode ray tube (CRT) and, more particularly, to a CRT which can effectively enhance electron beam deflection efficiency.

(b) Description of the Related Art

Generally, CRTs include a panel having an inner phosphor screen, a funnel having a cone portion, and a neck having an electron gun therein, which are sequentially connected to each other. A deflection yoke is mounted around the cone portion of the funnel to form horizontal and vertical magnetic fields there. In this structure, electron beams emitted from the electron gun are deflected through the horizontal and vertical magnetic fields from the deflection yoke, and land on the phosphor screen.

Recently, the CRTs have been employed for the use in highly sophisticated electronic devices such as high definition television (HDTV) and OA equipment.

On the one hand, in these applications, the consumption power of the CRT should be reduced to obtain good energy efficiency, and the leakage magnetic field due to the power consumption should be reduced to protect the user from the harmful electronic waves. In order to cope with these requirements, it turns out that the consumption power of the deflection yoke, which is the major consumption source, should be reduced in a suitable manner.

On the other hand, in order to realize high brightness and resolution of display images on the screen, it is required that the deflection power of the deflection yoke should increase. Specifically speaking, higher anode voltage is required for enhancing brightness of the screen and, correspondingly, higher deflection voltage is required for deflecting the electron beams accelerated by the increased anode voltage. Furthermore, higher deflection frequency is required for enhancing resolution of the screen, accompanying with the requirement of increased deflection power. In addition, in order to realize relatively flat CRTs for more convenient use, wide-angle deflection should be performed with respect to the electron beams and this also accompanies with the requirement of increased deflection power.

In this situation, there are needs for developing techniques for allowing the CRTs to retain good deflection efficiency while constantly maintaining the deflection power or reducing it.

For this purpose, conventionally, a technique of increasing the deflection efficiency is introduced by positioning the deflection yoke to be more adjacent to the electron beam paths. The positioning of the deflection yoke is achieved by reducing a diameter of the neck and an outer diameter of the funnel adjacent to the neck. However, in such a structure, the electron beams to be applied onto the screen corner portions are liable to bombard the inner wall of the funnel adjacent to the neck (This phenomenon is usually called the "beam shadow neck" or briefly the "BSN"). Consequently, the phosphors coated on the corresponding screen corner portions are not excited so that it becomes difficult to obtain good quality of screen images.

In order to solve such problems, it has been proposed that the cone portion of the funnel, around which the deflection yoke is mounted, should be formed with a shape where a circle gradually changes into a rectangle from a neck-side of the funnel to a panel-side. This shape corresponds to the deflection route of the electron beams. In this structure, the size of the cone portion is minimized so that the deflection yoke can be positioned to be more adjacent to the electron beam paths.

However, in the above technique, the cone portion of the funnel is merely designed to be formed with a rectangular shape without considering the practical moving routes of the electron beams in various directions, and thus does not cope with the beam shadow neck (BSN) in an appropriate manner.

SUMMARY OF THE INVENTION

It is an object of the present invention to provide a CRT which can effectively enhance electron beam deflection efficiency with appropriate structural components on the basis of the computer simulation technique.

This and other objects may be achieved by a CRT with a central axis. The CRT includes a panel with an inner phosphor screen and a rear portion. The panel has a substantially rectangular effective screen portion with two long sides in a horizontal axis direction, two short sides in a vertical axis direction and four edges in a diagonal axis direction. A funnel is connected to the rear portion of the panel. The funnel sequentially has a body with a large-sized end and a small-sized end, and a cone portion with a large-sized end and a small-sized end. The large-sized end of the body is sealed to the rear portion of the panel. The small-sized end of the body meets the large-sized end of the cone portion at a point. The meeting point of the body and the cone portion becomes an inflection point of the funnel. The cone portion has a sectional shape varying from a circle to a non-circle like a rectangle while proceeding from the small-sized end to the large-sized end such that the cone portion is provided with a curvature radius Rh in the horizontal axis direction, a curvature radius Rv in the vertical axis direction, and a curvature radius Rd in the diagonal axis direction. A neck is sealed to the small-sized end of the cone portion. An electron gun is fitted within the neck to produce electron beams. A deflection yoke is mounted around the cone portion of the funnel. The horizontal, vertical and diagonal curvature radii Rh, Rv and Rd of the cone portion of the funnel satisfy the following condition: $Rh<Rv<Rd$.

The cone portion of the funnel has an arc of circle with the horizontal curvature radius Rh, an arc of circle with the vertical curvature radius Rv, and an arc of circle with the diagonal curvature radius Rd. The arcs of circle with the horizontal, vertical and diagonal curvature radii Rh, Rv and Rd each have a center positioned toward the neck with respect to the small-sized end of the cone portion in the tube axis direction. The distance between the small-sized end of the cone portion and each center of the arcs of circle with the horizontal, vertical and diagonal curvature radii Rh, Rv and Rd is sequentially reduced.

Furthermore, the arcs of circle with the horizontal, vertical and diagonal curvature radii Rh, Rv and Rd have centers positioned toward an outer surface of the funnel with respect to the tube axis in the horizontal, vertical and diagonal axis directions, respectively. The distance between the tube axis and each center of the arcs of circle with the horizontal, vertical and diagonal curvature radii Rh, Rv and Rd sequentially increases.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
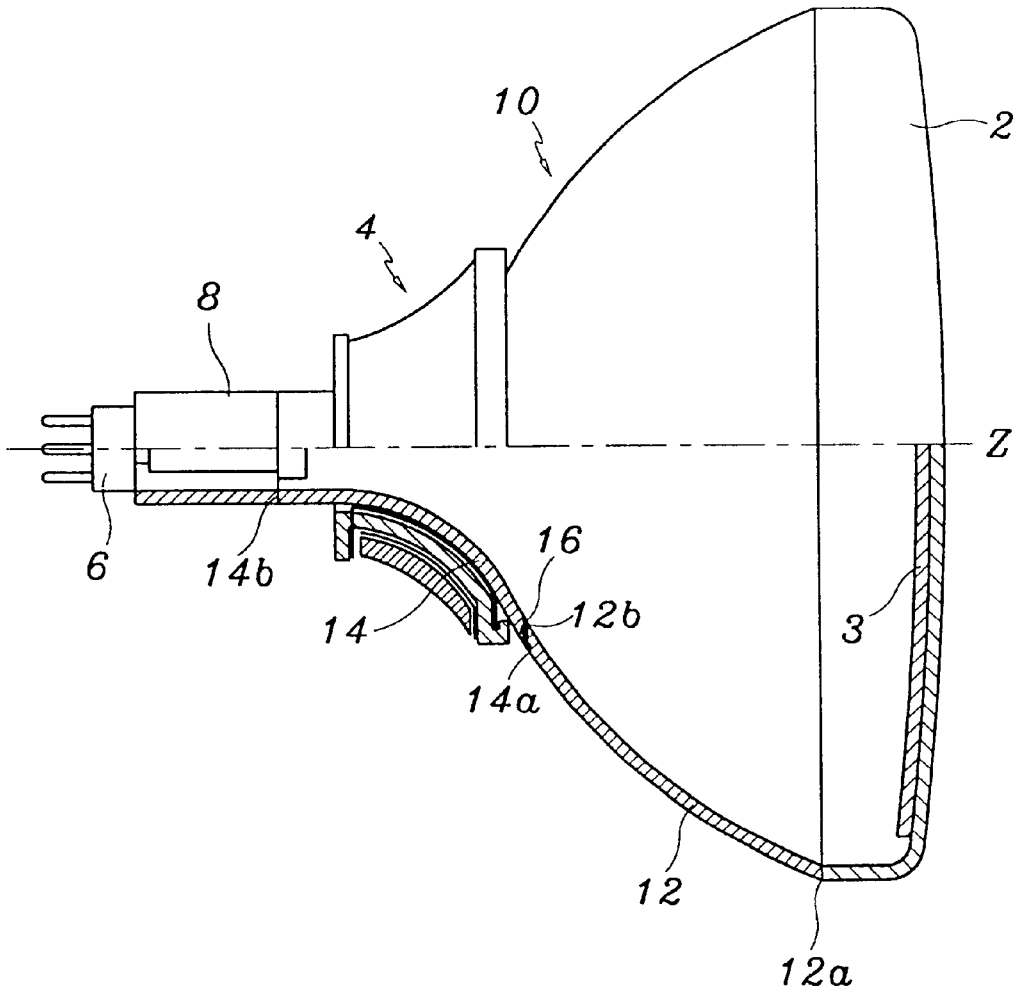
FIG. 1 is a partial sectional view of a CRT with a panel, a funnel and a neck according to a first preferred embodiment of the present invention.
Figure 2:
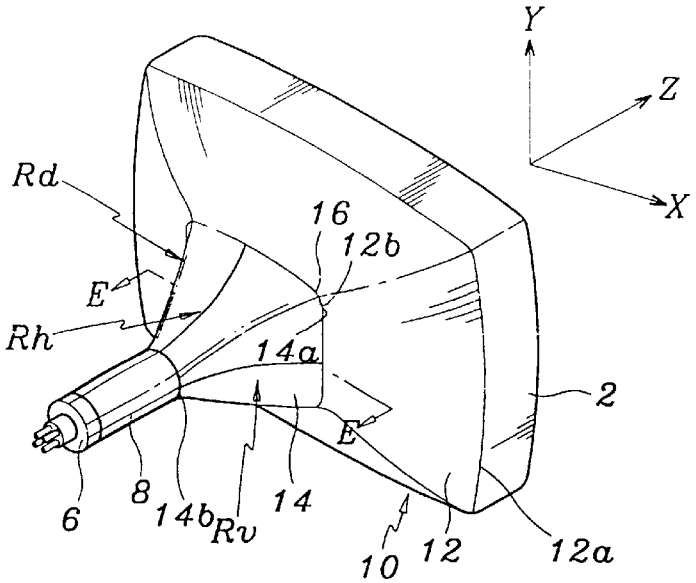
FIG. 2 is a rear perspective view of the CRT in FIG. 1.
Figure 3:
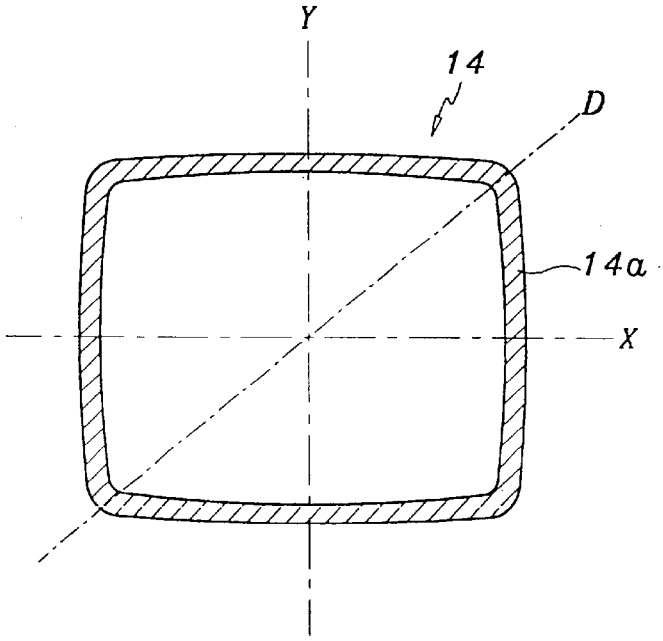
FIG. 3 is a sectional view of the CRT taken along the E—E line of FIG. 2.

FIG. 1 is a partial sectional view of a CRT with a panel 2 according to a preferred embodiment of the present invention, FIG. 2 is a perspective view of the CRT shown in FIG. 1, and FIG. 3 is a sectional view of the CRT taken along the E—E line of FIG. 2. The panel 2 has a substantially rectangular effective screen portion with two long sides in a horizontal direction, two short sides in a vertical direction and four edges in a diagonal direction. In the drawings, Z indicates a central axis of the CRT referred to hereinafter as the "tube axis", X indicates an axis of the panel 2 in the horizontal direction referred to hereinafter as the "horizontal axis", Y indicates an axis of the panel 2 in the vertical direction referred to hereinafter as the "vertical axis", and D indicates an axis of the panel 2 in the diagonal direction referred to hereinafter as the "diagonal axis".

As shown in the drawings, the panel 2 has an inner phosphor screen 3 and a rear portion. A funnel 10 is connected to the rear portion of the panel 2. The funnel 10 is sequentially provided with a body 12 with a large-sized end 12*a* and a small-sized end 12*b*, and a cone portion 14 also with a large-sized end 14*a* and a small-sized end 14*b*. The body 12 meets the cone portion 14 at a point 16, and the meeting point 16 of the body 12 and the cone portion 14 becomes an inflection point or the so-called top of round (TOR) of the funnel 10 at which the inner curved surface of the funnel 10 changes from depression (corresponding to the body 12) to prominence (corresponding to the cone portion 14). The funnel 10 is sealed to the rear portion of the panel 2 at the large-sized end 12*a* of the body 12. A neck 8 is sealed to the small-sized end 14*b* of the cone portion 14. An electron gun 6 is fitted within the neck 8 to produce electron beams. A deflection yoke 4 is mounted around the cone portion 14 of the funnel 10.

In consideration of the practical moving routes of the electron beams, the cone portion 14 of the funnel 10 is designed to have a sectional shape varying from a circle to a non-circle like a rectangle while proceeding from the small-sized end 14*b* to the large-sized end 14*a*. In this structure, the cone portion 14 of the funnel 10 has a curvature varying at different positions.

Specifically speaking, the cone portion 14 of the funnel 10 has a curvature radius Rh in the horizontal axis X direction referred to hereinafter as the "horizontal curvature radius", a curvature radius Rv in the vertical axis Y direction referred to hereinafter as the "vertical curvature radius", and a curvature radius Rd in the diagonal axis D direction referred to hereinafter as the "diagonal curvature radius". The curvature radii of Rh, Rv and Rd are established to satisfy the following condition: $Rh<Rv<Rd$.

In this structure, the cone portion 14 of the funnel 10 is shaped with three different arcs of circle each with a separate curvature radius from the large-sized end 14*a* to a small-sized end 14*b*.

Figure 4:
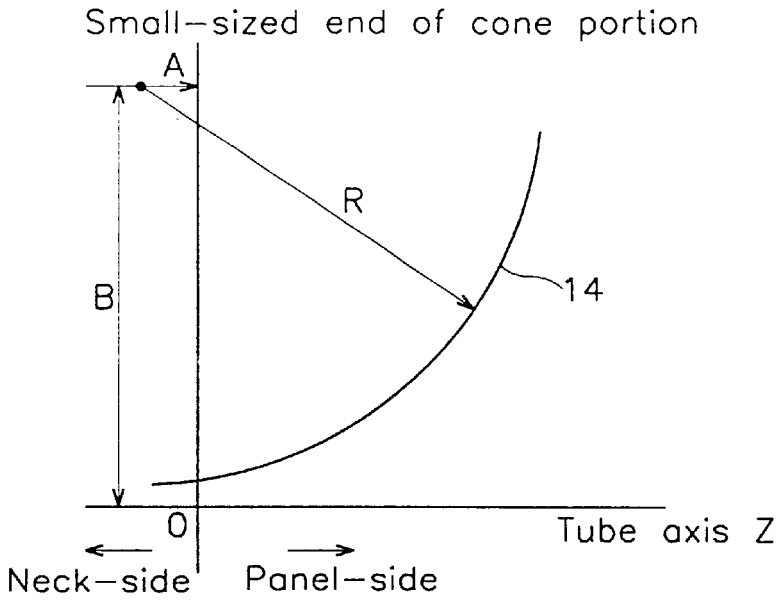
FIG. 4 is a graph illustrating eccentricity of arcs of circle of a cone portion of the funnel shown in FIG. 1 with respect to a reference line.

FIG. 4 is a graph illustrating eccentricity of each arc of circle with respect to a reference line. When the small sized end 14*b* of the cone portion 14 or the tube axis Z is determined to be such a reference line for evaluating eccentricity of each arc of circle thereto, the eccentricity of each arc of circle is defined by a distance between a center C of the arc of circle and the small-sized end 14*b* of the cone portion 14 or the tube axis Z. In the drawing, R indicates the curvature radius of each arc of circle, A indicates the eccentricity of each arc of circle with respect to the small-sized end 14*b* of the cone portion 14 in the tube axis Z direction, and B indicates the eccentricity of each arc of circle with respect to the tube axis Z in the horizontal axis X, vertical axis Y and diagonal axis D directions.

On the one hand, when the reference line is determined to be the small-sized end 14*b* of the cone portion 14, the arc of circle with the horizontal curvature radius Rh has an eccentricity Ah in the tube axis Z direction, the arc of circle with the vertical curvature radius Rv has an eccentricity Av in the tube axis Z direction, and the arc of circle with the diagonal curvature radius Rd has an eccentricity Ad in the tube axis Z direction. In case the panel 2 is assumed to be in a positive direction to the reference line, Ah, Av and Ad are all established to be a negative number and satisfy the following condition: $Ah>Av>Ad$.

On the other hand, when the reference line is determined to be the tube axis Z, the arc of circle with the horizontal curvature radius Rh has an eccentricity Bh in the horizontal axis X direction, the arc of circle with the vertical curvature radius Rv has an eccentricity Bv in the vertical axis Y direction, and the arc of circle with the diagonal curvature radius Rd has an eccentricity Bd in the diagonal axis D direction. In case the outer surface of the funnel 10 is assumed to be in a positive direction to the reference line, Bh, Bv and Bd are all established to be a positive number and satisfy the following condition: $Bh<Bv<Bd$.

The horizontal curvature radius Rh of the cone portion 14 further satisfies the following condition: $74.1\ \text{mm}-(s\times(\theta-91°))/10° \leqq Rh \leqq 84.8\ \text{mm}-(s\times(\theta-91°))/10°$ where θ indicates the deflection angle (°) of the electron beams, and s indicates the distance (mm) between the neighboring electron beams. The electron beam deflection angle θ may be defined as follows: where two lines are drawn from centers of diagonal edges of the effective screen portion of the panel 2 opposite to each other onto a tube axis Z line such that the angle between the tube axis Z line and each of the two lines reaches half the maximum deflection angle, θ indicates the angle between the two lines. The distance between the neighboring electron beams may be specified by the distance between the center of the R beam and the center of the G beam or the distance between the center of the G beam and the center of the B beam.

The vertical curvature radius Rv of the cone portion 14 further satisfies the following condition: $91.2\ \text{mm}-(s\times(\theta-91°))/10° \text{Rv} \leqq 98.6\ \text{mm}-(s\times(\theta-91°))/10°$.

In order to test practical effects of the CRT with the above-identified structure, a 19 inch CRT was fabricated. In the CRT, the deflection angle θ of the electron beams was 100°, and the distance s between the neighboring electron beams was 5.6 mm.

Figure 5:
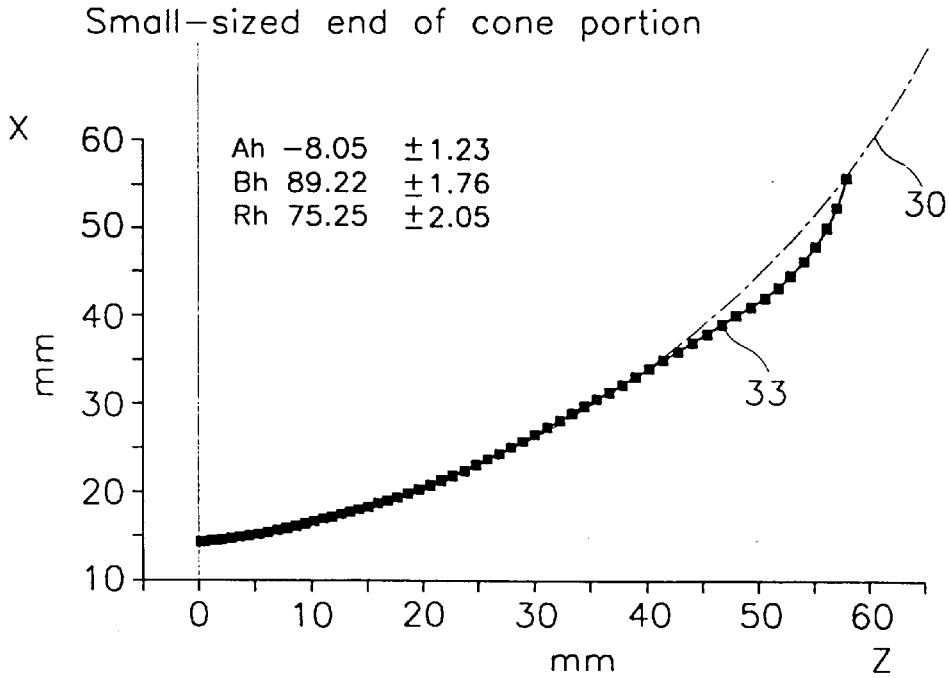
FIG. 5 is a graph illustrating the eccentricity of the arc of circle of the cone portion of the funnel shown in FIG. 1 in a horizontal axis X direction analyzed by a computer simulation technique.
Figure 6:
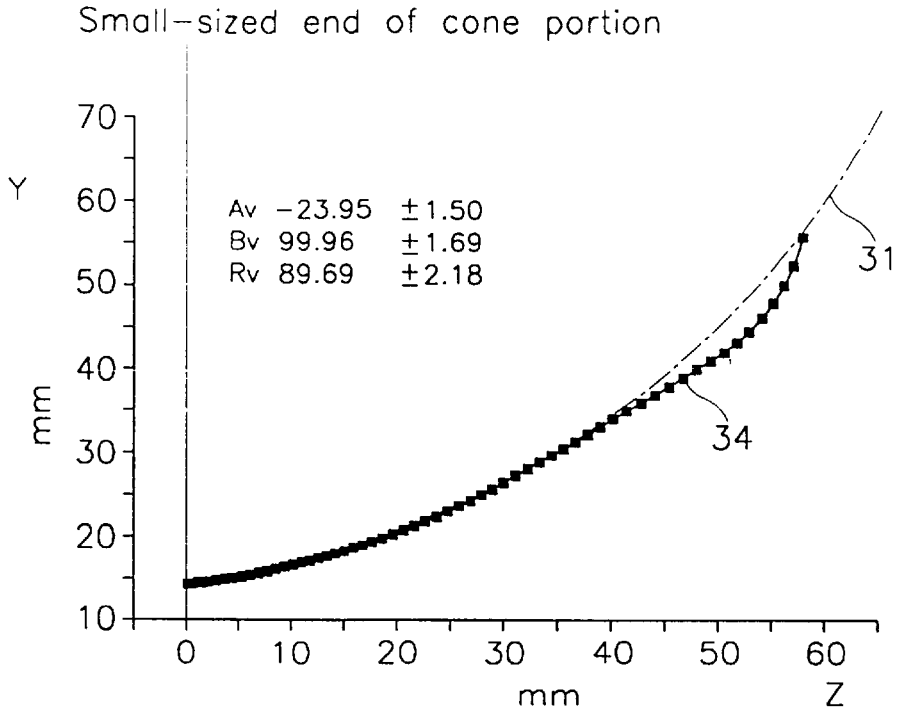
FIG. 6 is a graph illustrating the eccentricity of the arc of circle of the cone portion of the funnel shown in FIG. 1 in a vertical axis Y direction analyzed by a computer simulation technique.
Figure 7:
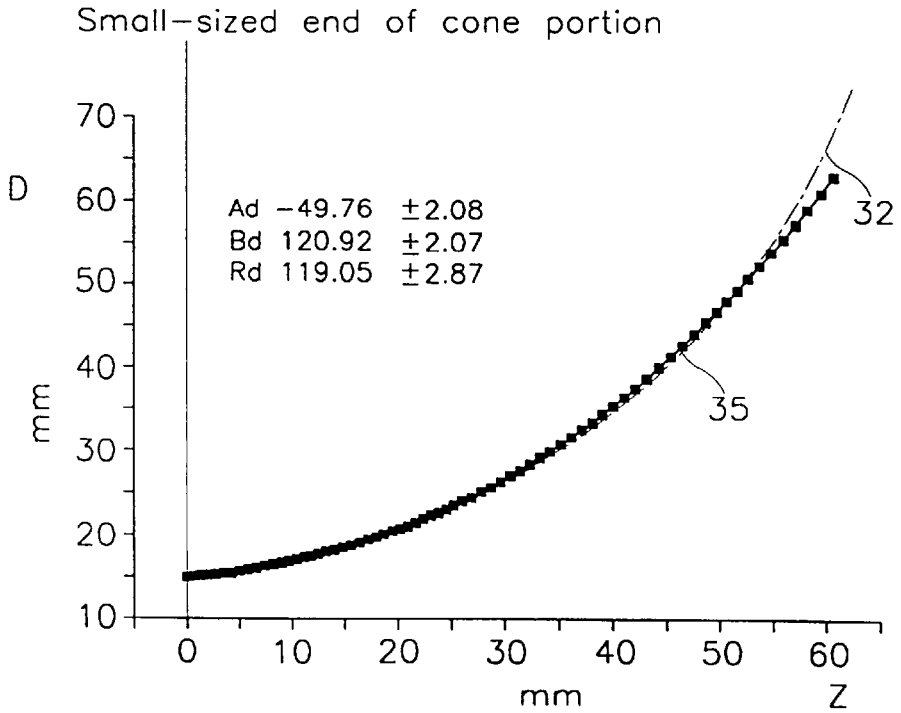
FIG. 7 is a graph illustrating the eccentricity of the arc of circle of the cone portion of the funnel shown in FIG. 1 in a diagonal axis D direction analyzed by a computer simulation technique.

FIGS. 5 to 7 are graphs illustrating the eccentricity of each arc of circle of the cone portion 14 of the CRT analyzed by a computer simulation technique.

In the drawings, short and long dashed lines 30, 31 and 32 indicate the theoretical outlines of the arcs of circle with the horizontal curvature radius Rh, the vertical curvature radius Rv and the diagonal curvature radius Rd, respectively, and curved lines 33, 34 and 36 each interconnecting squares indicate the practical outlines of the arcs of circle where the measurement is performed per 1 mm.

It is preferable that each practical value is within 2 mm from the corresponding theoretical value, and the overall sum of the difference between the practical values and the theoretical values is within 5 mm.

The curvature radius and the eccentricity of each arc of circle of the cone portion 14 of the CRT are listed in Table 1.

| | H | V | d |
|---|---|---|---|
| A | −8.05 ± 1.23 | −23.95 ± 1.50 | −49.76 ± 2.08 |
| B | 89.22 ± 1.76 | 99.96 ± 1.69 | 120.92 ± 2.07 |
| R | 79.25 ± 2.05 | 89.69 ± 2.18 | 119.05 ± 2.87 |

It can be known from Table 1 that Ah, Av and Ad are all negative numbers, and Bh, Bv and Bd are all positive numbers. The absolute value of each eccentricity indicates the distance between the center of each arc of circle and the reference line.

As described above, the inventive CRT can effectively enhance electron beam efficiency by optimally forming the cone portion 14 of the funnel 10 using the computer simulation technique.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A cathode ray tube with a central axis, the cathode ray tube comprising:

a panel with an inner phosphor screen and a rear portion, the panel having a substantially rectangular effective screen portion with two long sides in a horizontal axis direction, two short sides in a vertical axis direction and four edges in a diagonal axis direction;

a funnel connected to the rear portion of the panel, the funnel sequentially having a body with a large-sized end and a small-sized end, and a cone portion with a large-sized end and a small sized end, the large sized end of the body being sealed to the rear portion of the panel, the small-sized end of the body meeting the large sized end of the cone portion at a point, the meeting point of the body and the cone portion being an inflection point of the funnel, the cone portion having sides forming a cross-sectional shape varying from a circle to a substantially rectangular shape while proceeding along the central axis from the small sized end to the large sized end such that the cone portion is provided with a curvature radius Rh on one said side which extends in the horizontal axis direction, a curvature radius Rv on one said side which extends in the vertical axis direction, and a curvature radius Rd at an edge formed by the sides in the diagonal axis direction;

a neck sealed to the small-sized end of the cone portion;

an electron gun fitted within the neck to produce electron beams; and a deflection yoke mounted around the cone portion of the funnel;

wherein the horizontal, vertical and diagonal curvature radii Rh, Rv and Rd of the cone portion of the funnel satisfy the following condition: Rh<Rv<Rd; and the cone portion of the funnel has an arc of circle with the horizontal curvature radius Rh, and arc of circle with the vertical curvature radius Rv, and an arc of circle with the diagonal curvature radius Rd.

2. The cathode ray tube of claim 1 wherein the arcs of circle with the horizontal, vertical and diagonal curvature radii Rh, Rv and Rd each have a center positioned toward the neck in the tube axis direction with respect to the small-sized end of the cone portion, and the distance between the small-sized end of the cone portion and each center of the arcs of circle with the horizontal, vertical and diagonal curvature radii Rh, Rv and Rd is sequentially reduced.

3. The cathode ray tube of claim 1 wherein the arcs of circle with the horizontal, vertical and diagonal curvature radii Rh, Rv, and Rd have centers positioned toward an outer surface of the funnel with respect to the tube axis in the horizontal, vertical and diagonal axis directions respectively, and the distance between the tube axis and each center of the arcs of circle with the horizontal, vertical and diagonal curvature radii Rh, Rv and Rd increases respectively.

4. The cathode ray tube of claim 1 wherein the horizontal curvature radius Rh satisfies the following condition: $74.1\ \text{mm}-(s\times(\theta-91°))/10° \leqq \text{Rh} \leqq 84.8\ \text{mm}-(s\times(\theta-91°))/10°$ where θ indicates the deflection angle (°) of the electron beams, and s indicates the distance (mm) between the neighboring electron beams.

5. The cathode ray tube of claim 1 wherein the vertical curvature radius Rv satisfies the following condition $91.2\ \text{mm}-(s\times(\theta-91°))/10° \leqq \text{Rv} \leqq 98.6\ \text{mm}-(s\times(\theta-91°))/10°$ where θ indicates the deflection angle (°) of the electron beams, and s indicates the distance (mm) between the neighboring electron beams.

6. The cathode ray tube of claim 1 wherein the diagonal curvature radius Rd satisfies the following condition: $120.9\ \text{mm}-(s\times(\theta-91°))/10° \leqq \text{Rd} \leqq 128.1\ \text{mm}-(s\times(\theta-91°))/10°$ where θ indicates the deflection angle (° ) of the electron beams, and s indicates the distance (mm) between the neighboring electron beams.

* * * * *